United States Patent [19]

Kallenbach

[11] Patent Number: 4,982,754

[45] Date of Patent: Jan. 8, 1991

[54] POOL CLEANER ACCESSORY

[75] Inventor: Dieter H. F. Kallenbach, Chartwell, South Africa

[73] Assignee: BPH Patent Holding AG, Zug, Switzerland

[21] Appl. No.: 403,604

[22] Filed: Sep. 6, 1989

[30] Foreign Application Priority Data

Sep. 9, 1988 [ZA] South Africa ..... 88/6719

[51] Int. Cl.[5] ..... E04H 4/16

[52] U.S. Cl. ..... 134/167 R; 15/1.7

[58] Field of Search ..... 134/167 R, 168 R, 167 C, 134/168 C; 15/1.7, 104.33; 210/169; 285/38

[56] References Cited

U.S. PATENT DOCUMENTS

| | | | |
|---|---|---|---|
| 1,762,065 | 6/1930 | Lally | 285/38 X |
| 3,041,089 | 6/1962 | Purues | 285/38 X |
| 3,820,172 | 6/1974 | Kane | 134/168 X |
| 3,939,861 | 2/1976 | Thompson | 285/38 X |
| 4,356,582 | 11/1982 | Stephenson | 134/167 R X |
| 4,776,954 | 10/1988 | Brooks | 15/1.7 X |

FOREIGN PATENT DOCUMENTS

| | | | |
|---|---|---|---|
| 751258 | 6/1956 | United Kingdom | 15/104.33 |

*Primary Examiner*—Philip R. Coe

*Attorney, Agent, or Firm*—Kilpatrick & Cody

[57] ABSTRACT

This invention concerns automatic swimming pool cleaner accessories which may be used to prevent such pool cleaners from following a substantial fixed pattern over a submerged surface to be cleaned and consists of a collar shaped to firmly engage the flexible hose used with a pool clenar, the collar having a plurality of projections extending radially from the collar. The projections may be stems terminating in spherical members at their outer ends.

3 Claims, 1 Drawing Sheet

POOL CLEANER ACCESSORY

BACKGROUND TO THE INVENTION

This invention relates to an accessory for use with swimming pool cleaners.

With swimming pool cleaners which operate on movement caused by an interruption of the flow of water through the cleaner induced by the pump for the filter operation, there is in some circumstance a tendecy for the pool cleaner to follow a substantially fixed pattern. This prevents proper cleaning being affected.

The above disadvantage has been found to be prevalent in above ground circular pools utilising a viny lining to retain the water but it also occurs in other types of swimming pools.

The object of the present invention is to provide an accessory which will at least substantially avoid such inefficient cleaning by the pool cleaner.

SUMMARY OF THE INVENTION

According to this invention there is provided a swimming pool cleaner accessory comprising a collar to firmly engage the flexible hose used with a pool cleaner, the collar having a plurality of projections which extend radially from the hose and are spaced apart around the periphery of the collar.

Further features of this invention provide for the collar to co-operate with connections between lengths of suction hose and for the projections to be spherical members located on the ends of stems projecting from the collar.

Preferably there are four projections equally spaced around the collar.

BRIEF DESCRIPTION OF THE DRAWINGS

The drawings show in

FIG. 1 an oblique view of the collar according to this invention and in

Figure 1:
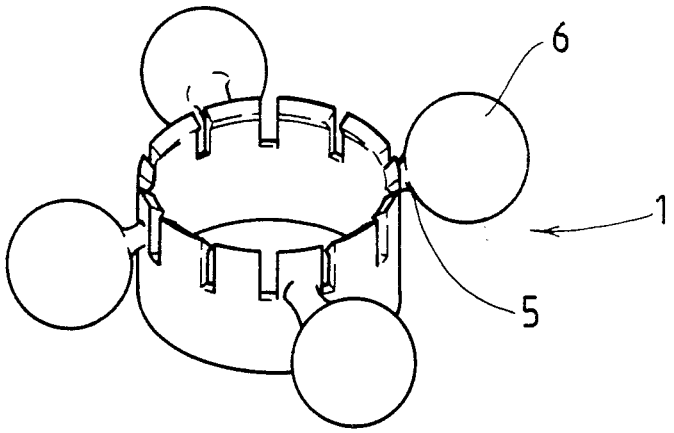
Figure 2:
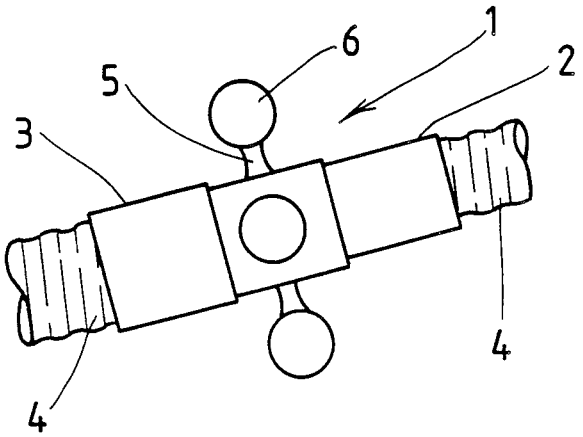
FIG. 2 the collar located on a flexible hose As shown in the preferred embodiment of the invention illustrated the collar 1 is moulded from plastics material and is made to fit between the tapered spigot 2 and socket 3 connection elements for lengths of flexible hose 4 for the cleaner (not shown). Thus one end of the collar 1 is tapered inwardly and there are preferably longitudinal slots through the wall at this end. This end may thus be inserted in sealing engagement in the socket 3 of the flexible pipe length. The other end of the collar is formed as a socket to receive the spigot 2 on the contiguous pipe length.

Four radially extending stems 5 on the collar 1 terminate in spherical members 6 to form projections.

The collar and projection will be made to have a substantially neutral buoyancy so that they will not appreciably affect the position of the flexible pipe insofar as the depth of the latter in the water is concerned. In use the flexible pipe will cross under itself in following a fixed pattern. This in turn will result in the projections engaging the pipe as it moves into a cross-over configuration. This causes stresses to be induced until the projections suddenly slip free from the engaged part of the pipe. The result is a sudden jerk in the pipe which causes the cleaner to move in different direction.

The use of the accessory has proven to be effective in preventing the cleaner from developing a fixed pattern of movement and ensuring the desired random pattern of movement to give overall cleaning of the submerged surfaces of the pool.

What I claim as new and desire to secure by Letters Patent is:

1. A swimming pool cleaner accessory comprising a collar to firmly couple contiguous lengths of flexible hose used with a pool cleaner, the collar having a plurality of projections to effect random movement of the pool cleaner which extend radially from the hose and are spaced apart around the periphery of the collar, the projections formed as spherical members on the outer ends of stems projecting from the collar.

2. A swimming pool cleaner accessory as claimed in claim 1 in which there are four projections equally spaced apart around the collar.

3. A swimming pool cleaner as claimed in claimed 1 in which the material from which the collar is made has a neutral buoyancy in water.

* * * * *

UNITED STATES PATENT AND TRADEMARK OFFICE

CERTIFICATE OF CORRECTION

PATENT NO. : 4,982,754

DATED : January 8, 1991

INVENTOR(S) : Dieter Kallenbach

It is certified that error appears in the above-identified patent and that said Letters Patent is hereby corrected as shown below:

Column 1, line 11: [tendecy] -- tendency --
Column 1, line 14: [viny] -- vinyl --

Signed and Sealed this

Second Day of June, 1992

*Attest:*

DOUGLAS B. COMER

*Attesting Officer*

*Acting Commissioner of Patents and Trademarks*